US011060274B2

(12) United States Patent
Shuhaibar

(10) Patent No.: US 11,060,274 B2
(45) **Date of Patent: *Jul. 13, 2021**

(54) SPLIT GUSSET CONNECTION

(71) Applicant: Constantine Shuhaibar, San Francisco, CA (US)

(72) Inventor: Constantine Shuhaibar, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/417,365

(22) Filed: May 20, 2019

(65) Prior Publication Data

US 2019/0271145 A1 Sep. 5, 2019

Related U.S. Application Data

(63) Continuation of application No. 15/724,072, filed on Oct. 3, 2017, now Pat. No. 10,294,657, which is a (Continued)

(51) Int. Cl.
*E04B 1/24* (2006.01)
*E04C 3/04* (2006.01)
*E04H 9/02* (2006.01)

(52) U.S. Cl.
CPC ..... *E04B 1/2403* (2013.01); *E04B 1/24* (2013.01); *E04B 2001/2415* (2013.01); (Continued)

(58) Field of Classification Search
CPC . E04B 1/18; E04B 1/1972; E04B 1/24; E04B 1/2403; E04B 2001/2415; E04B 2001/2418; E04B 2001/2451; E04B 2001/2454; E04B 2001/2448; E04B 2001/2496; E04B 2001/2439; E04B 1/185; E04B 1/1903; E04H 9/028; E04C 2003/026; E04C 2003/0486; E04C 2003/0491; E04C 2003/0495; E04C 3/06; E04C 3/32; E04C 3/02; E04C 3/04
See application file for complete search history.

(56) References Cited

U.S. PATENT DOCUMENTS 4,409,765 A 10/1983 Pall
6,474,902 B1 11/2002 Beauvoir
(Continued)

FOREIGN PATENT DOCUMENTS

JP 09-209477 A 8/1997
JP H10-037515 A 2/1998
(Continued)

OTHER PUBLICATIONS

International Preliminary Report on Patentability dated Aug. 29, 2013, from PCT Application No. PCT/US2012/025122 (7 pages).
(Continued)

*Primary Examiner* — Jessica L Laux
(74) *Attorney, Agent, or Firm* — Willink & Hunt LLP

(57) ABSTRACT

A gusset connection that allows greater relative movement between connected structural members and simplifies erection in the field. The gusset connection can be a first gusset portion moveably connected to a vertical column and a second gusset connection moveably connected to a horizontal beam.

18 Claims, 12 Drawing Sheets

Related U.S. Application Data continuation of application No. 14/006,963, filed as application No. PCT/US2012/025122 on Feb. 14, 2012, now Pat. No. 9,856,640.

(60) Provisional application No. 61/442,738, filed on Feb. 14, 2011.

(52) U.S. Cl.
CPC ..... *E04B 2001/2439* (2013.01); *E04B 2001/2448* (2013.01); *E04B 2001/2463* (2013.01); *E04B 2001/2496* (2013.01); *E04C 2003/0491* (2013.01); *E04H 9/028* (2013.01)

(56) References Cited

U.S. PATENT DOCUMENTS

| | | | | |
|---|---|---|---|---|
| 6,516,583 | B1 | 2/2003 | Houghton | |
| 7,703,244 | B2 * | 4/2010 | Suzuki | E04B 1/24 403/169 |
| 7,784,226 | B2 | 8/2010 | Ichikawa et al. | |
| 8,161,707 | B2 | 4/2012 | Simmons | |
| 8,511,033 | B2 | 8/2013 | Kumakawa et al. | |
| 2004/0074161 | A1 * | 4/2004 | Kasai | E04H 9/02 52/167.1 |
| 2004/0107654 | A1 | 6/2004 | Powell et al. | |
| 2005/0005561 | A1 | 1/2005 | Hanson | |
| 2005/0108959 | A1 | 5/2005 | Powell | |
| 2006/0144006 | A1 | 6/2006 | Suzuki et al. | |
| 2007/0245643 | A1 | 10/2007 | Ichikawa et al. | |
| 2007/0261356 | A1 | 11/2007 | Vaughn | |
| 2008/0289267 | A1 | 11/2008 | Sarkisian | |
| 2009/0165419 | A1 * | 7/2009 | Richard | E04B 1/24 52/650.2 |
| 2009/0223166 | A1 | 9/2009 | Ohata et al. | |
| 2014/0083046 | A1 | 3/2014 | Yang | |

FOREIGN PATENT DOCUMENTS

| | | | |
|---|---|---|---|
| JP | 2000-186371 | A | 7/2000 |
| JP | 2001-107458 | A | 4/2001 |

OTHER PUBLICATIONS

Extended European Search Report dated Jun. 18, 2014, from European Application No. 12746785.0 (7 pages).

International Search Report dated Aug. 22, 2012 for PCT Patent Application No. PCT/US2012/025122, 5 pages.

Written Opinion dated Aug. 22, 2012 for PCT Patent Application No. PCT/US2012/025122, 4 pages.

Wigle, Victoria R. et al., Finite Element Parametric Studies of Buckling-Restrained Braced Frame Connections, The 14th World Conference on Earthquake Engineering, Oct. 12-17, 2008, Beijing, China, 8 pages.

Lin, Min-Lang et al., Compressive Behavior of Buckling-Restrained Brace Gusset Connections, The First International Conference on Advances in Experimental Structural Engineering AESE, Jul. 19-21, 2005, Nagoya, Japan, 8 pages.

Thornton, William A et al., Design of vertical Bracing Connections for High-Seismic Drift, Modern Steel Construction, Mar. 2009, 4 pages.

Commentary on the Seismic Provisions for Structural Steel Buildings, American Institute of Steel Construction, Jun. 22, 2010, 248 pages.

Buckling Restrained Braces, Star Seismic® Brochure, Park City, Utah, 2013.

First Office Action dated Jul. 3, 2015, from Chinese Application No. 201280008650.X (22 pages).

Notice of Reasons for Rejection in Japanese Application No. 2013-553663, dated Oct. 28, 2015.

Korean Intellectual Property Office, Non-Final Rejection, App. No. 10-2013-7024224, dated Feb. 13, 2018, including Eng. Translation (20 pages).

Canadian Intellectual Property Office, Office Action and Examination Search Report, App. No. 2,826,767, dated Feb. 27, 2018 (5 pages).

Korean Intellectual Property Office, Final Rejection, App. No. 10-2013-7024224, dated Jun. 28, 2018, including Eng. Translation 6 pages).

* cited by examiner

200a
Br
G
202
200b
Br
OR 200a
204
G
202
Br
200b
200
C
WELD
200a
G
Br
202
200b
204
WELD
WP2
WP1
Bm

Br
200a
202
204
200b

SS

DS

WELDED

SS

DS

BOLTED

Br
Br

OR
702
704
Br

OR
702
704
702
Br
704
C
WEB
702
℄
WELD
702
℄
Br
700
706
704
WELD
WP2
Bm
℄
WP1
704
Bc
WEB

Br
802
804
WELD
C
800
806
Bm
WEB
WP1
WP2

SPLIT GUSSET CONNECTION

This application is a continuation of U.S. Ser. No. 15/724,072, filed on Oct. 3, 2017, which is a continuation U.S. Ser. No. 14/006,963, filed on Jul. 14, 2014, which is the National Stage of International Application No. PCT/US12/25122, filed on Feb. 14, 2012, which claims the benefit of U.S. Provisional Application No. 61/442,738, filed Feb. 14, 2011, all of which are incorporated by reference herein.

BACKGROUND

This invention generally concerns a structural joint, and more specifically concerns a gusset connection that allows greater relative movement between connected structural members and simplifies erection in the field.

FIG. 1A shows a typical prior art gusset connection in a braced frame structure. A horizontal structural member Bm (beam) is connected to a vertical structural member C (column). To connect the diagonal structural member Br (i.e., brace) to the beam-column assembly, a gusset plate G is used. The brace is connected (e.g., pinned, bolted) to the gusset and the gusset is connected to both the beam and the column, typically by welding. Length $L_{cc}$ is the clear length of the column C between ends of gusset plates G, and length $L_{bc}$ is the clear length of the beam Bm between ends of gusset plates G.

The addition of the prior art gusset plate, which can be welded to the beam and column, creates fixity where relative motion of the beam Bm and column C is not possible. In practice, this leads to the introduction of large internal forces applied to portions of the beams and columns. FIG. 1B shows respective bending moments $M_b/M_c$ in the beam Bm and column C and respective shear forces $V_b/V_c$ in the beam Bm and column C that are resultant in a structure from the use of a bolted/welded gusset plate G. Also shown are the bending moment $M_{br}$ and shear force $V_{br}$ for brace Br. While FIG. 1B shows a bolted configuration between the beam Bm and column C, the same forces occur in welded joints (and welded and bolted) configurations as shown in FIG. 1C.

Shear force $V_b$ is proportional to bending moment $M_b$ and beam clear length $L_{bc}$ (i.e., $V_b \propto M_b/L_{bc}$). Likewise, shear force $V_c$ is proportional to bending moment $M_c$ and column clear length $L_{cc}$ (i.e., $V_c \propto M_c/L_{cc}$). Increasing the width and height of the gusset plates to strengthen the joints directly reduces the beam clear length $L_{bc}$ and column clear length $L_{cc}$, which in turn causes larger shear forces $V_b$ and $V_c$ to occur for otherwise the same bending moments $M_b$ and $M_c$ applied to the structure by external forces (e.g., winds, earthquakes, etc.). In extreme situations these large internal forces can fracture the beam, the beam to column bolted/welded assembly, the column, and/or the gusset welds, if the prior art connection parts are not designed accordingly. However, if all the prior art connection parts are designed to accommodate the large internal forces, then structure weight, material requirements, and cost increase significantly.

BRIEF SUMMARY OF THE INVENTION

One embodiment of the invention provides a structural joint. A vertical column may have a first gusset portion. A horizontal beam may be connected to the vertical column. The horizontal beam may have a second gusset portion which is not directly connected to the first gusset portion. A diagonal brace may be moveably connected to the first gusset portion and the second gusset portion.

In some aspects, the first gusset portion may be fixedly connected to the vertical column at a joint location. A horizontal beam may be fixedly connected to the vertical column at the joint location. The horizontal beam can have a second gusset portion fixedly connected to the horizontal beam. The second gusset portion may be spaced apart from the first gusset portion at the joint location. The diagonal brace can be moveably connected to the first gusset portion and the second gusset portion at the joint location. The diagonal brace can be moveably connected to the first gusset portion via a first moveable connection. The diagonal brace can be moveably connected to the second gusset portion via a second moveable connection. The first and second moveable connections can be separate from each other.

In some aspects, the first gusset portion and second gusset portions may be first and second gusset plates, respectively, separated by a gap.

In some aspects, the diagonal brace may be moveably connected to at least one of the gusset plates by a plurality of bolts.

In some aspects, the plurality of bolts may pass through horizontally, vertically, or angularly oriented slots of the at least one gusset plate and brace.

In some aspects, the diagonal brace may be also rotatably connected within the gap by a pin.

In some aspects, the first gusset portion and second gusset portion may be stubs. The stubs may be moveably connected to a gusset plate, which may be secured to the diagonal brace.

In some aspects, the stubs may be moveably connected to the gusset plate by a plurality of bolts.

In some aspects, the plurality of bolts may pass through horizontally oriented, vertically oriented, angularly oriented, or curved slots of the stubs and/or the gusset plate and/or the brace.

One embodiment of the invention provides a structural joint including a column. A beam can be fixedly connected to the column at a fixed connection. A brace can be moveably connected to beam and column via a gusset assembly. The beam can be fixedly connected to a first portion of the gusset assembly and the column can be fixedly connected to a second portion of the gusset assembly. A means for moveably connecting the brace to the gusset assembly can be provided such that potentially destructive forces applied to the beam are transferred to the column via the fixed connection and not by the first portion of the gusset assembly, and such that the potentially destructive forces applied to the column are transferred to the beam via the fixed connection and not by the second portion of the gusset assembly.

One embodiment of the invention provides a method for assembling a structural joint. In the method, a beam is fixedly connected to a column to create a joint. A gusset is assembled at the joint for attachment of a brace, or the beam and column can include pre-manufactured gusset portions where the joint is made. A brace can be moveably connected to the gusset such that forces applied to the beam that move the beam do not move the column via transfer of force from the gusset, and such that forces applied to the column do not move the beam via transfer of force from the gusset.

These and other embodiments of the invention are described in further detail below with reference to the following figures.

DETAILED DESCRIPTION OF THE INVENTION

Figure 1A:
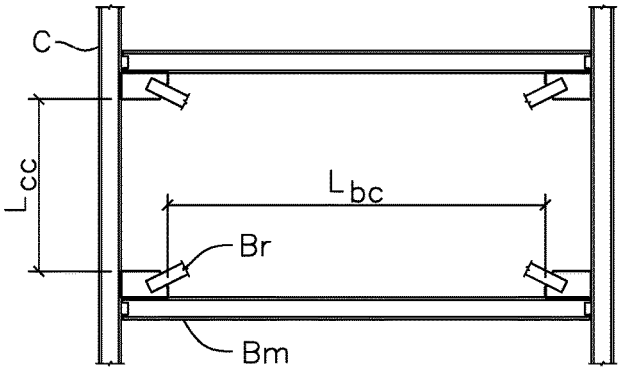
FIGS. 1A-1C are various side views of a prior-art braced frame structure.

Embodiments of the invention include a gusset that adds minimal stress to all components it is connected to, such as a beam and column. In this case, the beam, column, and brace see minimal increases in their stresses by adding our gusset. Thus, the advantage of the prior art gusset (to enable brace beam coupling to a column and beam joint) is maintained, while the unwanted force transfer attributes of the prior art gusset (due to large earthquake-like forces) are in large part negated. Accordingly, for a structure having a beam/column/brace joint, when external forces (e.g., earthquake forces) are applied, the inventive gusset will not transfer movement of the beam to the column, movement of the column to the beam, and movement of the brace to the beam and/or column—as would a standard gusset connection. Thus, force transfer between the column, beam, and brace will occur as if the inventive gusset was not present, but instead will mimic true dynamic loads around an imaginary work point that connects all three members. In some embodiments, the inventive gusset itself may also have lower stresses than the prior art gusset. All of this is achieved by allowing greater relative movement between connected members via the inventive gusset connection.

Embodiments of the invention provide a gusset for joining a column, beam, and a diagonal support member for a steel-framed building. The gusset allows for the column and beam to hold and support the diagonal support for the triangulating loads, as is typically expected for a standard prior art gusset. In addition, the gusset also allows the column, beam, and diagonal support to independently move relative to each other in reaction to extreme dynamic loads, which may be the result of extreme winds or earthquakes, and which may also cause a prior-art joint to fail.

Accordingly, relative to a prior art gusset, the inventive gusset does not transfer (significant) movement of the beam to the column, and vice-versa, and thus the gusset does not amplify and/or transfer dynamic loads. For example, a swaying moment enacted on a column will expectedly it to move, and to some degree a beam connected thereto, however the inventive gusset will not transfer the swaying moment onto the beam, and thus not amplify the effects of movement caused by a prior art gusset. The inventive gusset can include a first gusset portion moveably or fixedly connected to a column and a second gusset portion moveably or fixedly connected to a beam. These gusset portions are not directly connected to each other, and are moveably, fixedly, and/or rotatably connected to a diagonal support.

As used herein, "moveably connected" or "moveable" or "moving connection" is understood to mean a connection between two or more structural members which allows for horizontal and or/vertical relative movement between the members under extreme dynamic loading. Such a connection typically does not allow movement under static or typical dynamic loads (e.g., as applied from light/medium force winds). Relative to a prior art bolted gusset, "moveably connected" should be understood to allow movement well beyond drill hole tolerances. An example of a moveable connection is a secured bolt within a slot, which is secured to not move under static or typical dynamic loads, but can move within slots under extreme dynamic loads. Accordingly, slotted bolt connections as described herein should be understood to be moveable connections. It should be well understood, that where slotted connections are disclosed, only one connected portion (e.g., gusset plates, brace) is required to include slots to provide the moveable connection. However, in some embodiments, more than one or all connected portions include slots to provide the moveable connection.

As used herein, "fixedly connected" or "fixed connection" or "non-moveably connected" is understood to mean a connection between two or more structural members which is not configured to provide relative movement (beyond what a prior art bolted gusset provides). An example of a fixed connection is a welded joint or a bolted connection, and in some cases a welded and bolted connection. To some degree, bolt hole tolerances can allow limited movement, however, this may or may not occur under high loads and will certainly be well limited, and thus ultimately mimic a welded connection. Accordingly, welded joints and bolted connections (in the absence of slots) as described herein should be assumed to be fixed connections.

As used herein, "rotatably connected" or "rotatable connection" or "rotating connection" is understood to mean a connection between two or more structural members which allows rotational relative movement between the members. An example of a rotatable connection is a pin joint. Accordingly, pin joints as described herein should be assumed to be rotational connections. However, gusset assemblies having pins situated within a gap will allow for rotational, horizontal and/or vertical relative movement.

As used herein, "force" or "earthquake-like force" or "potentially destructive force" is understood to be dynamic forces externally applied to a building structure that far exceed dynamic loads applied by normal winds and shifting internal building loads. Such forces can be applied from earthquakes, hurricanes, tsunamis, and the like.

Figures 2A, 2B, 2C, 2D, 2E:
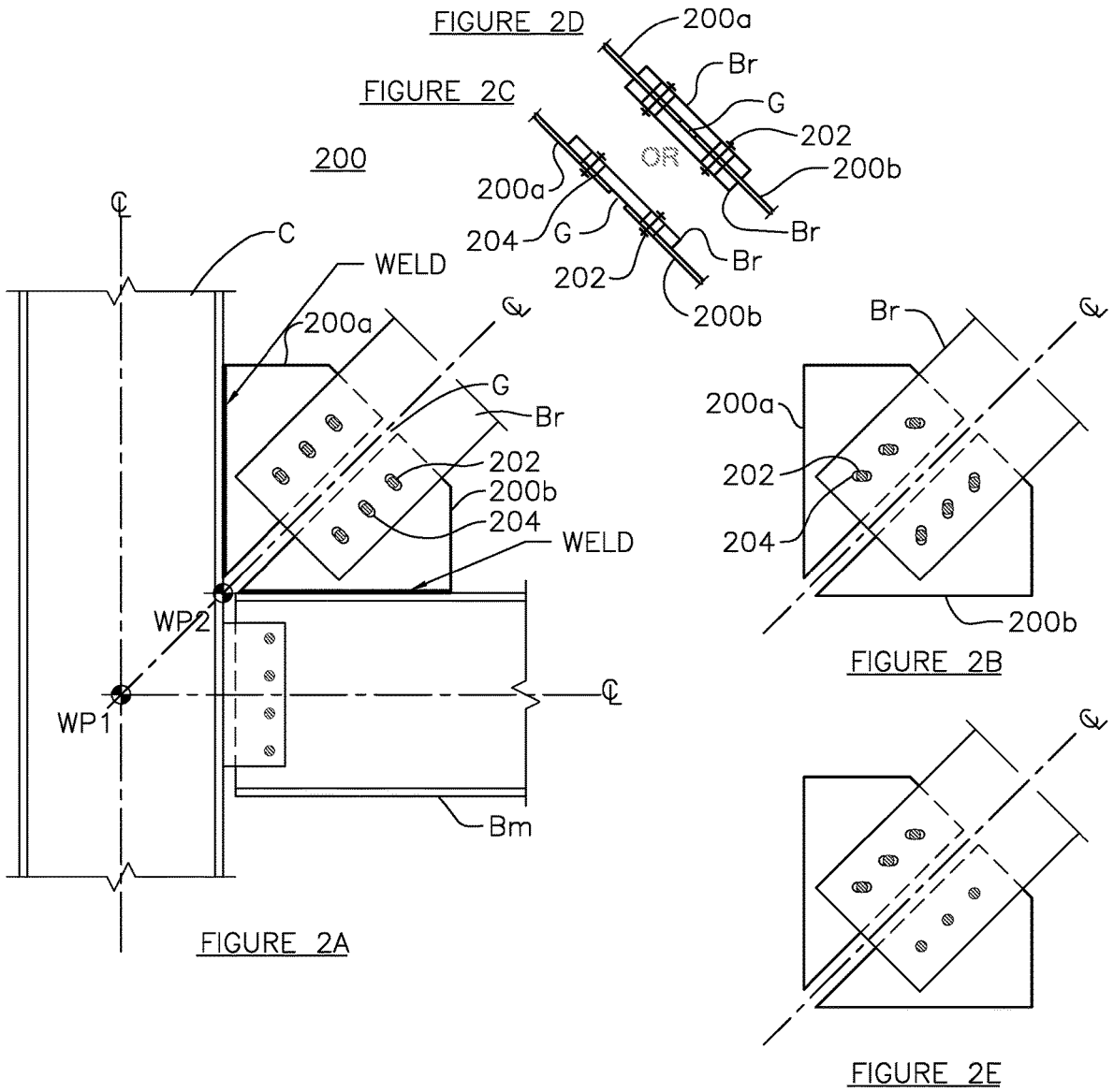
FIGS. 2A-2E are various side or end views of a braced frame joint, according to embodiments of the invention.

FIG. 2A shows a beam-column-brace joined by a gusset assembly 200, according to one embodiment of the invention. The gusset assembly 200 includes two gusset plates 200*a*/200*b* separated by a gap. The gap should be wide enough to provide enough free movement without collision of the two gusset plates 200*a*/200*b*. In some embodiments, width of the gap ranges from 12 mm-300 mm, or more commonly between 25 mm-100 mm. Gusset plate 200*b* is fixedly connected to the beam Bm by, for example, welding thereto, and likewise, gusset plate 200*a* is welded the column C. The diagonal brace Br is bolted to both gusset plates using a plurality of bolts 202. Generally, the column C, beam Bm, and brace Br are prefabricated structural elements, such as I-beams or tubes. It should be understood that use of the term "bolt" is meant to include a variety of fasteners such as bolt/nut combinations, screws, rivets, etc. The gusset plates 200*a*/200*b* can be constructed from a high strength materials such as steel plate or composites. Thickness and other dimensions of the gusset plates 200*a*/200*b* can be derived from the requirements of the particular structure that is being constructed, in the same manner as a prior art gusset plate.

The plurality of bolts 202 are moveably connected within slotted bolt holes 204 of the gusset plates 200*a*/200*b* and diagonal brace Br. As assembled, the slotted bolt holes 204 are perpendicular to the shown centerline of the gap G, and thus angularly oriented with regards to the structure as a whole. In some embodiments, curved slots may be used. The gap and slots 204 allow the gusset plates 200*a*/200*b* to move relative to each other. Accordingly, the beam Bm and column C can move relative to each other (since they are fixedly connected to the gusset plates 200*a*/200*b*) effectively as if the gusset was not present, and thus rotate around work point WP1, which is where centerlines of the beam Bm and column C intersect. An alternative work point WP2 is placed at where the centerline of the gap G physically intersects the beam Bm and column C joint. This arrangement prevents the transfer of respective dynamic loads applied to the column C and beam Bm to one another via the gusset plates 202*a*/202*b*.

In some embodiments, the bolts are secured to the faces of the gusset plates through an overly large hole instead of a slot using large washers. A polymer, rubber, or soft-metal O-ring may be situated within this overly large hole to help center the bolt and/or absorb shock, vibrations, and forces. The bolts within the slots 204 can be tightened to a degree that is performed with a prior art connection, and in some cases less so or more so. It is expected that earthquake-like forces will be so large to make bolt tightness a non-critical factor. When potentially destructive forces are applied to the gusset assembly 200, it does not behave in the manner depicted in FIG. 1A, where bending moment induced shear forces are amplified by presence of the gusset.

In some embodiments, only the diagonal brace Br or the gusset plates 200*a*/200*b* include the slots, while the other includes tapped holes for the bolt to directly secure to.

Figure 1B:
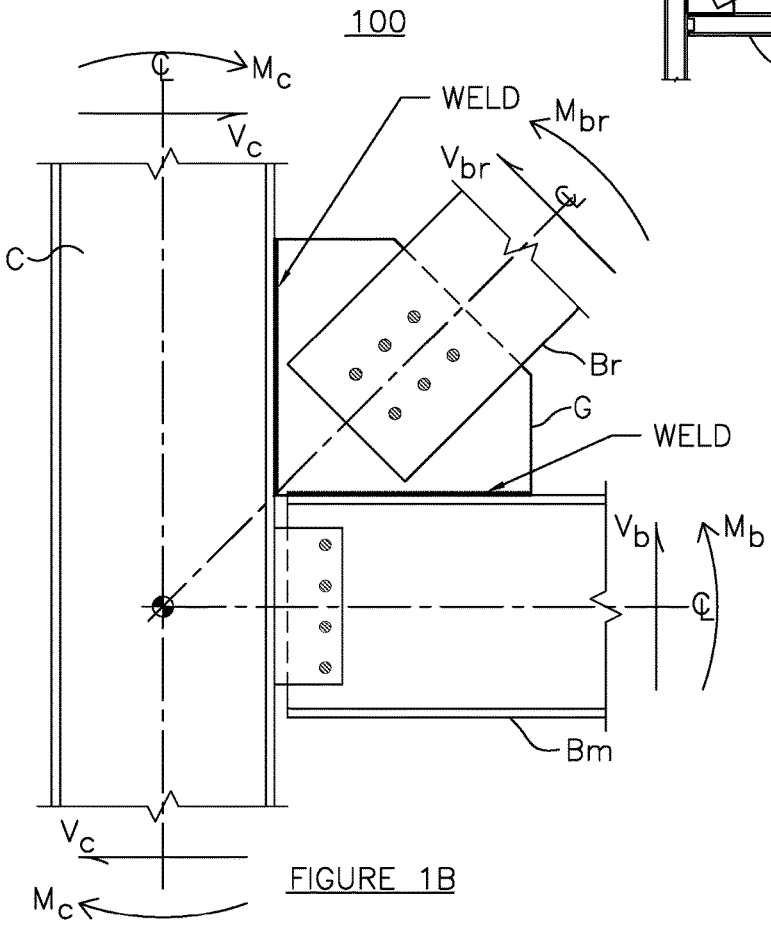
Figure 1C:
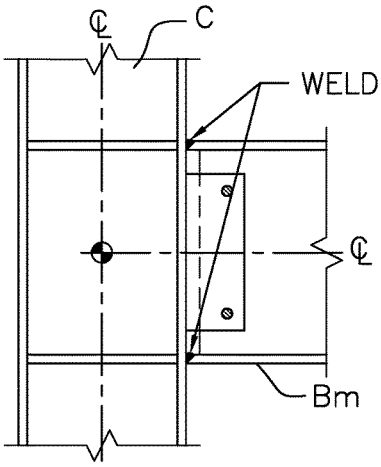

One advantage of the invention is the ability to weld the gusset plates 202*a*/202*b* to the beam Bm and column C in a shop (i.e., off the construction site) and simply assemble the components using the bolts 202 in the field (i.e., field bolting on the construction site). The prior art arrangement in FIG. 1 requires welding on the construction site, which is less reliable and accurate, less controlled, more costly, and more time-consuming than shop welding. In an ideal situation, structural members are prefabricated as much as possible and little to no structural connecting via welding is required at the construction site. For these reasons and more, shop welding and field bolting are strongly preferred in the construction industry.

FIG. 2B shows the same arrangement as FIG. 2A with one set of slotted bolt holes 204 in gusset plate 200*b* being perpendicular to the centerline of the beam Bm, and thus vertically oriented with regards to the structure as a whole. The other set of slotted holes 204 in gusset plate 200*a* are perpendicular to the centerline of the column C, and thus horizontally oriented with regards to the structure as a whole.

This arrangement still allows the relative movement of beam Bm and column C that FIG. 2A provides, and may serve to isolate the forces transferred from the brace Br to the beam Bm and the column C. Since the bolt holes 200 in gusset plate 202*b* are vertical, vertical motion is allowed (no force transfer), and force can only be transferred horizontally where the bolts bear on the plate. A similar condition occurs at gusset plate 202*a*, where horizontal movement is allowed (no force transfer), and force can only be transferred vertically where the bolts bear on the plate. Thus, the fixed connection (e.g., weld) at the beam Bm receives horizontal force only (parallel to the weld) and the fixed connection (e.g., weld) at the column C receives vertical force only (parallel to the fixed connection).

FIGS. 2C and 2D show end views of the gusset assembly 200. As shown, the brace Br can be moveably connected to only one side of the gussets 202*a*/202*b*, as depicted in FIG. 2C. Alternatively, the brace Br can be moveably connected to both sides of the gussets 202*a*/202*b* as depicted in FIG. 2D.

FIG. 2E shows an embodiment where only one gusset plate includes slots 204, while the other gusset plate is fixedly connected (e.g., bolted and/or welded).

Figure 3A:
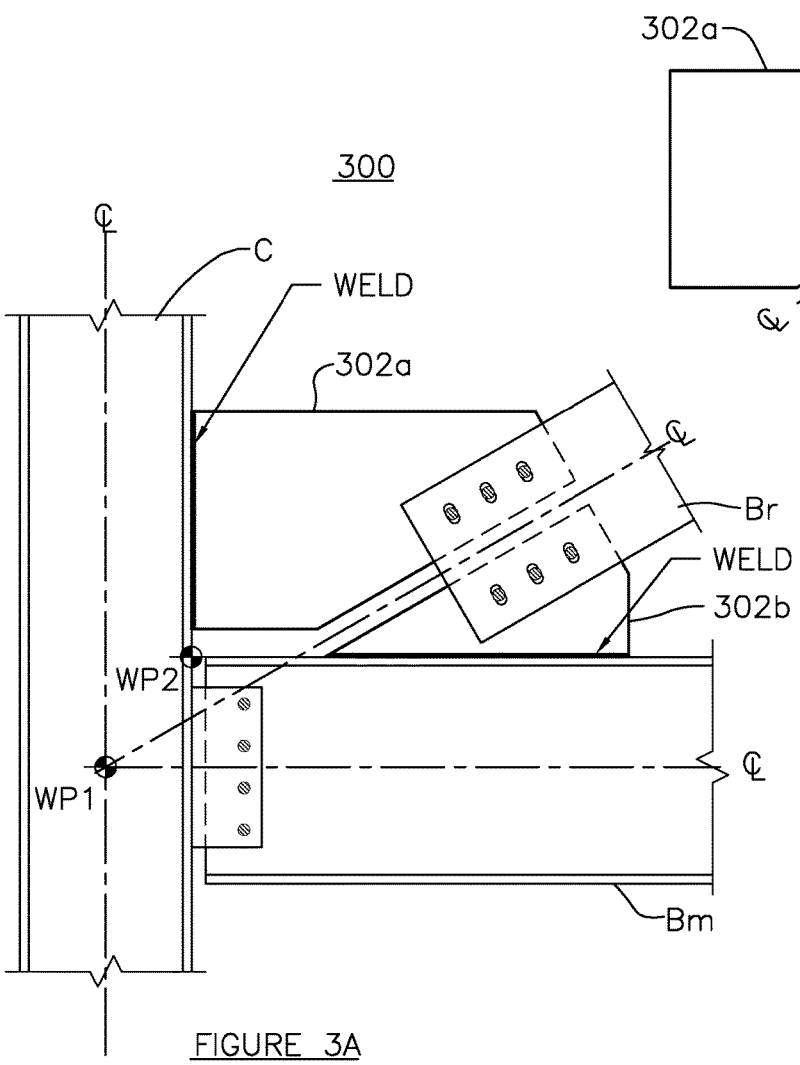
FIGS. 3A and 3B are side views of an acute angle braced frame joint, relative to a beam, according to embodiments of the invention.
Figure 3B:
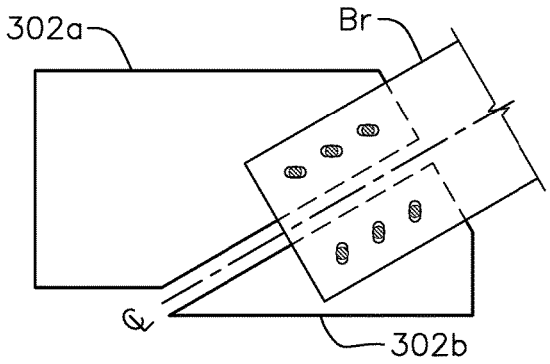

FIGS. 3A and 3B show alternative gusset assemblies 300 of the gusset assemblies 200 shown in FIGS. 2A and 2B, respectively. Here, the main difference between those assemblies is that brace Br is configured at an acute angle, and thus the gusset plates 302*a*/302*b* are not symmetric about dividing centerline CL. As shown, the gusset plates 302*a*/302*b* are configured such that the dividing centerline CL intersects work point WP1. Accordingly, gusset plate 302*a* is larger than gusset plate 302*b*. Alternatively, the dividing centerline CL can be shifted in a parallel manner to intersect WP2, as shown in FIG. 2A. This alternative embodiment would create a more central gap between the gusset plates 302*a*/302*b* than what is shown. In all other aspects, the gusset assemblies 300 can be constructed as disclosed with regards to gusset plate assembly 200.

Figure 4A:
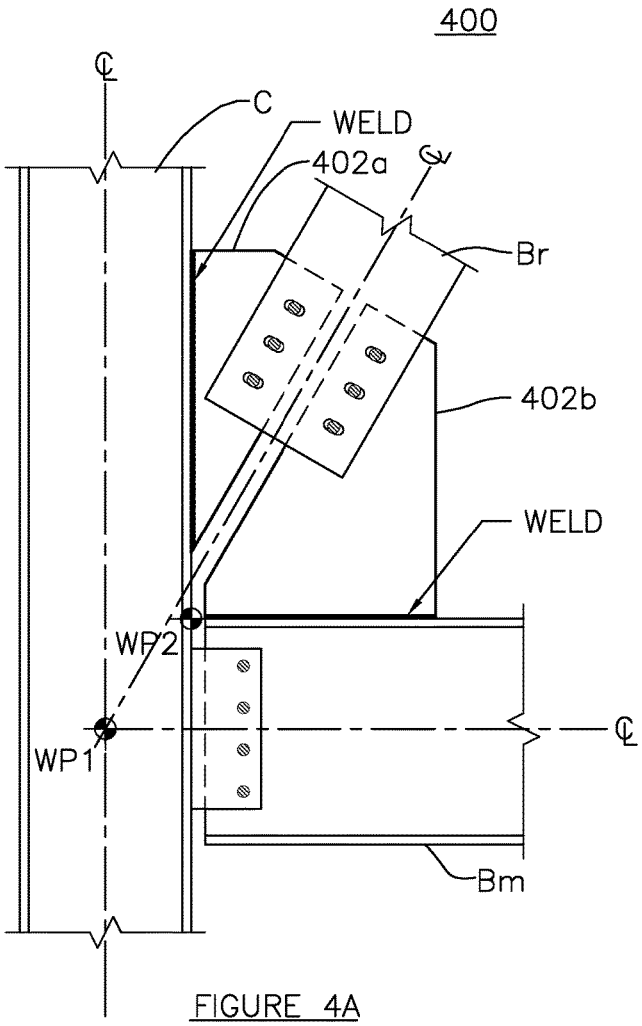
FIGS. 4A and 4B are side views of an acute angle braced frame joint, relative to a column, according to embodiments of the invention.
Figure 4B:
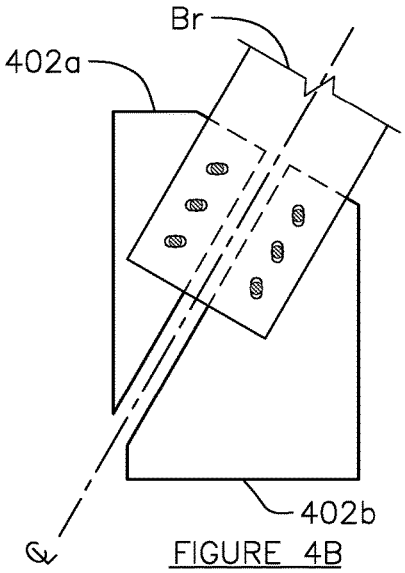

FIGS. 4A and 4B show alternative gusset assemblies 400 of the gusset assemblies 300 shown in FIGS. 3A and 3B, respectively. Here, the main difference between those assemblies is that brace Br is configured at an obtuse angle. As shown, the gusset plates 302*a*/302*b* are configured such that the dividing centerline CL intersects work point WP1. Accordingly, gusset plate 402*a* is larger than gusset plate 402*b*. Alternatively, the dividing centerline CL can be shifted in a parallel manner to intersect WP2, as shown in FIG. 2A. This alternative embodiment would create a more central gap between the gusset plates 402*a*/402*b* than what is shown. In all other aspects, the gusset assemblies 400 can be constructed as disclosed with regards to gusset plate assembly 200.

Figure 5:
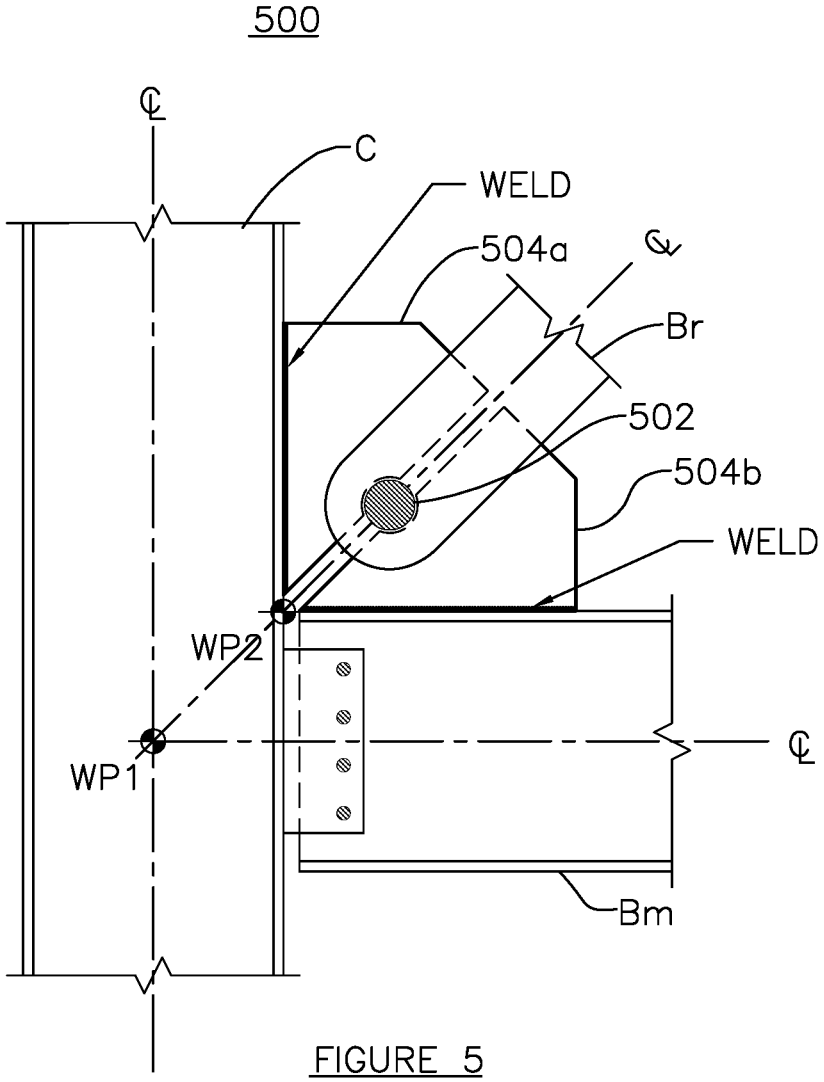
FIG. 5 is a side view of a pinned gusset assembly, according to one embodiment of the invention.

FIG. 5 shows a beam-column-brace joint connected by a gusset assembly 500, according to one embodiment of the invention. Here, the diagonal brace Br is connected to the gusset assembly 500 using a single pin 502 instead of a plurality of bolts. To accommodate the pin 502, a semi-circular cut is made in each of the gusset plates 504*a*/504*b* along the gap edges to cradle the pin. This connection allows for relative horizontal and vertical relative movement via presence of the gap, which is spaced both horizontally and vertically, as well as rotational relative movement via the pin 500. In all other aspects, the gusset assembly 500 can be constructed as disclosed with regards to gusset plate assembly 200.

Figure 6B:
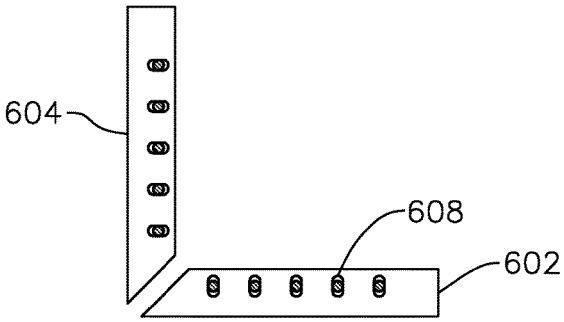
FIGS. 6A-6H are various side or end views of a braced frame joint, according to embodiments of the invention.
Figure 6C:
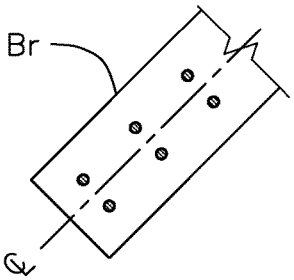
Figure 6D:
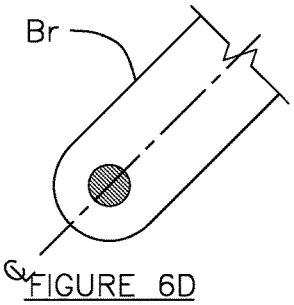
Figure 6A:
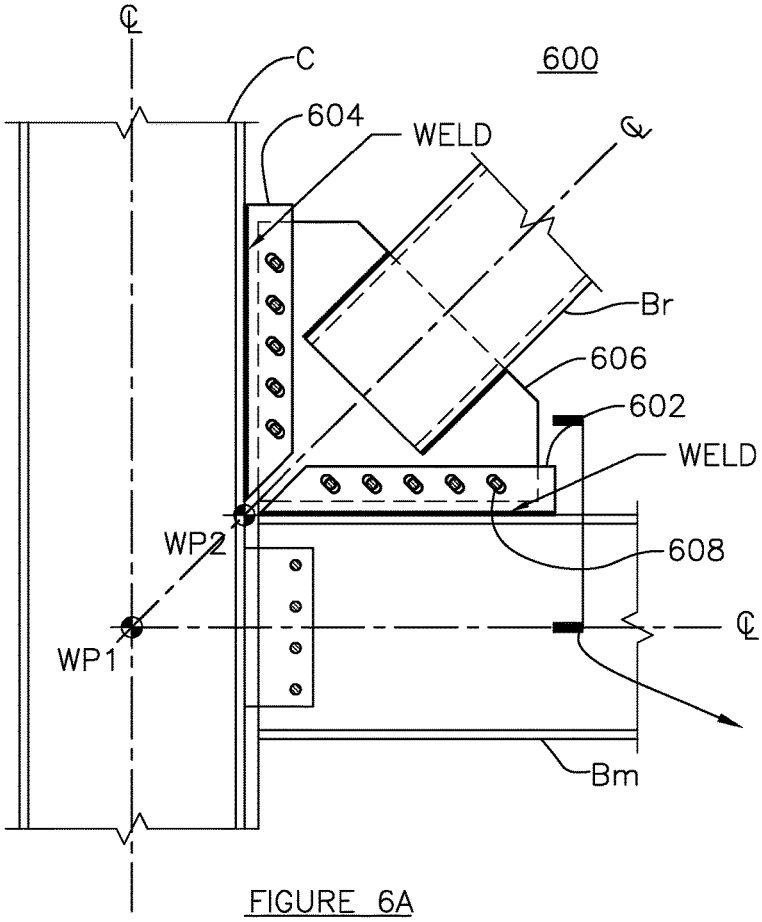

FIG. 6A shows a beam-column-brace assembly connected by a gusset assembly 600, according to one embodiment of the invention. Here, the gusset assembly 600 includes a first stub 602 which is fixedly connected to the beam Bm by a fixed connection (e.g., bolting and/or welding). A second stub 604 fixedly connected to the column C in a similar fashion. A gusset plate 606 is fixedly connected to the brace Br. The first stub 602 and the second stub 604 can be constructed from a extruded material, such as steel "angle iron". The gusset plate 606 is moveably connected to the first stub 602 using slotted bolt holes 608 that are oriented diagonally (perpendicular to centerline CL). Horizontal and vertical gaps are respectively present between the edges of the gusset plate 606 and the beam Bm and column C. This arrangement allows relative movement of beam Bm and column C, as described herein, and also provides the added advantage of isolating the forces transferred from the brace Br to the beam Bm and column C.

FIG. 6B shows an alternative arrangement of the first stub 602 and the second stub 604 for gusset assembly 600. Here, the gusset plate 606 is moveably connected to the first stub 602 using slotted bolt holes 608 that are vertically oriented. Similarly, the gusset plate 606 is moveably connected to the second stub 604 using slotted bolt holes 608 that are horizontally oriented.

FIGS. 6C and 6D show alternative arrangements of the attachments of the brace Br to the gusset plate 606. FIG. 6C shows the brace Br in a bolted configuration. FIG. 6D shows brace Br pinned to the gusset plate via a large pin, which may be rotatable.

Figure 6E:
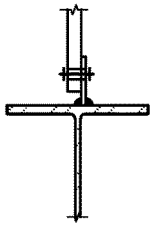
Figure 6F:
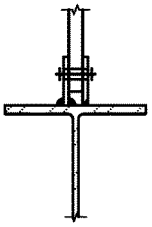
Figure 6G:
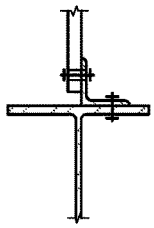
Figure 6H:
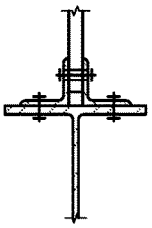

FIGS. 6E, 6F, 6G, and 6H various configuration for attachment of the first stub 602 and second stub 604 to the beam Bm and column C, respectively. FIGS. 6E and 6F shows single sided and double sided stub attachment configurations, respectively, that are welded to the beam Br or column C. FIGS. 6G and 6H show single-sided and double-sided stub attachment configurations, respectively, that are bolted to the beam Br or column C.

Figures 7A, 7B, 7C, 7D:
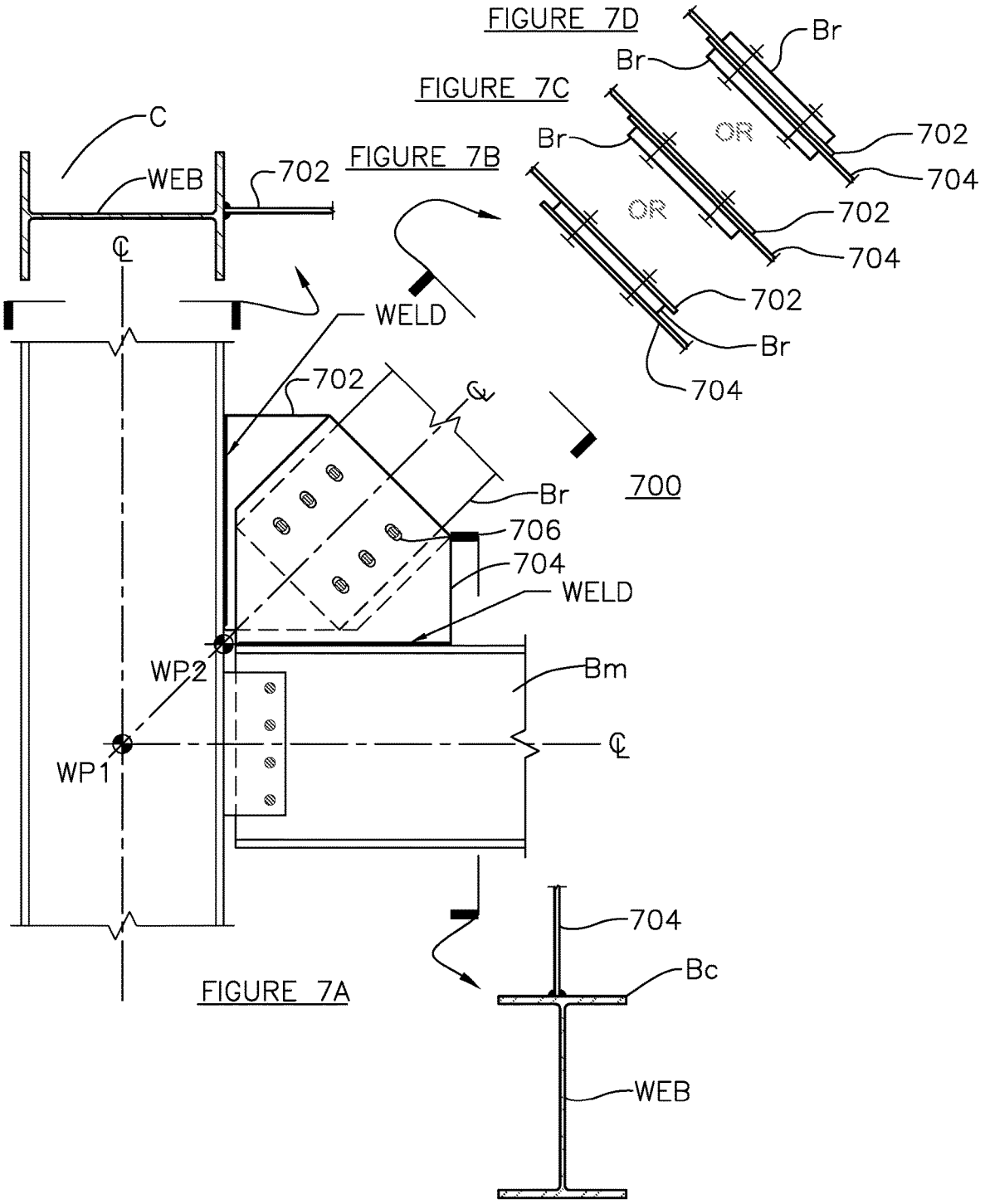
FIGS. 7A-7D are various side or end views of a braced frame joint, according to embodiments of the invention.

FIG. 7A shows a beam-column-brace assembly connected by a gusset assembly 700, according to one embodiment of the invention. The gusset assembly 700 is similar to what is disclosed in FIG. 2A. However, here, the gusset assembly 700 includes a first gusset plate 702 fixedly attached to the column C and a second gusset plate 704 fixedly attached to the beam Bm. The first gusset plate 702 and the second gusset plate 704 are offset from the centerlines of the beam and the column that bisect their webs, such that the first gusset plate 702 and the second gusset plate 704 slide past each other in different planes. The brace Br is bolted to both gusset plates via slotted holes 706 arranged at an angle (perpendicular to the centerline of the centerline CL) are used.

FIGS. 7B, 7C, and 7D show different arrangements of the gusset assembly 700. In FIG. 7B the first gusset plate 702 and second gusset plate 704 are arranged as shown in FIG. 7A, such that brace Br is located therebetween. Alternatively, as shown in FIG. 7C, the first gusset plate 702 and second gusset plate 704 can be arranged such that one side of the brace Br is exposed. In such an arrangement, both the first gusset plate 702 and second gusset plate 704 are arranged on the same side of webs of the column C and beam Bm. Alternatively, as shown in FIG. 7D, the first gusset plate 702 and second gusset plate 704 can be arranged to contact one another at inner sides, with the brace Br being doubly placed at outer sides.

Figures 8A, 8B, 8C, 8D:
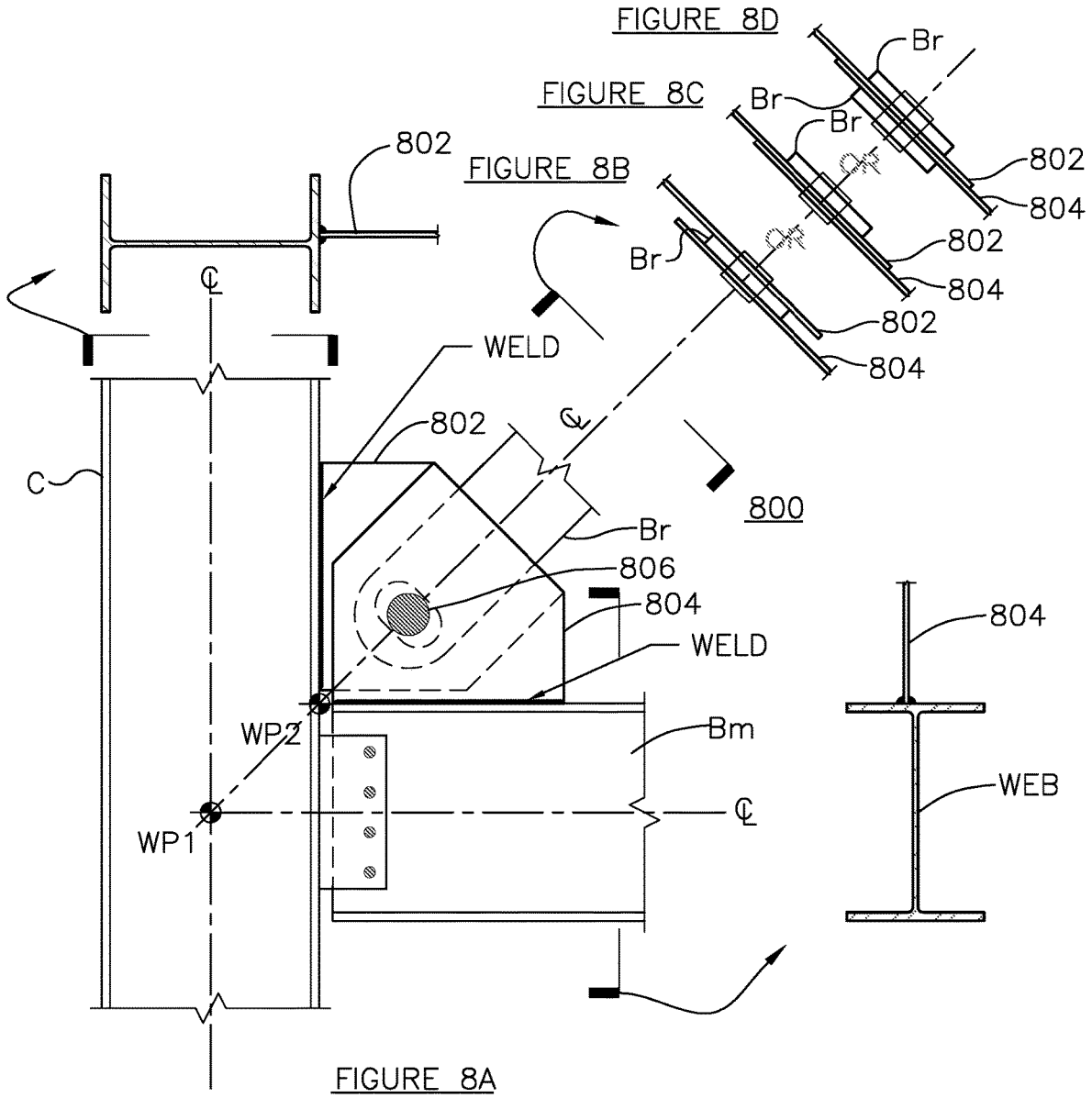
FIGS. 8A-8D are various side or end views of a pinned braced frame joint, according to embodiments of the invention.

FIG. 8A shows a beam-column-brace assembly connected by a gusset assembly 800, according to one embodiment of the invention. Gusset assembly 800 is similar to gusset assembly 700, but here gusset plates 802 and 804 are interconnected to brace Br by a physical pin. An oversized hole is made in gusset plates 802 and 804 that allows them to move perpendicular the centerline CL of the brace Br. Similarly with respect to FIGS. 7B-7D, FIGS. 8B-8D respectively show that the brace Br can be sandwiched between the two gusset plates 802 and 804, or be on one side of the gusset plates 802 and 804, or the brace Br having a forked end can sandwich both gusset plates 802 and 804.

Figure 9B:
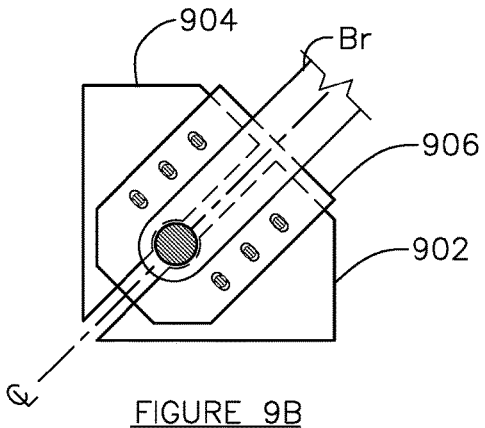
FIGS. 9A-9D are various side or end views of a braced frame joint, according to embodiments of the invention.
Figure 9C:
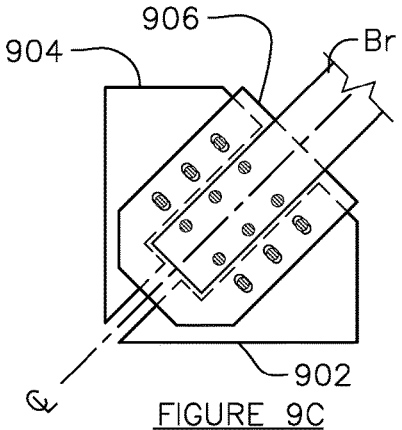
Figure 9A:
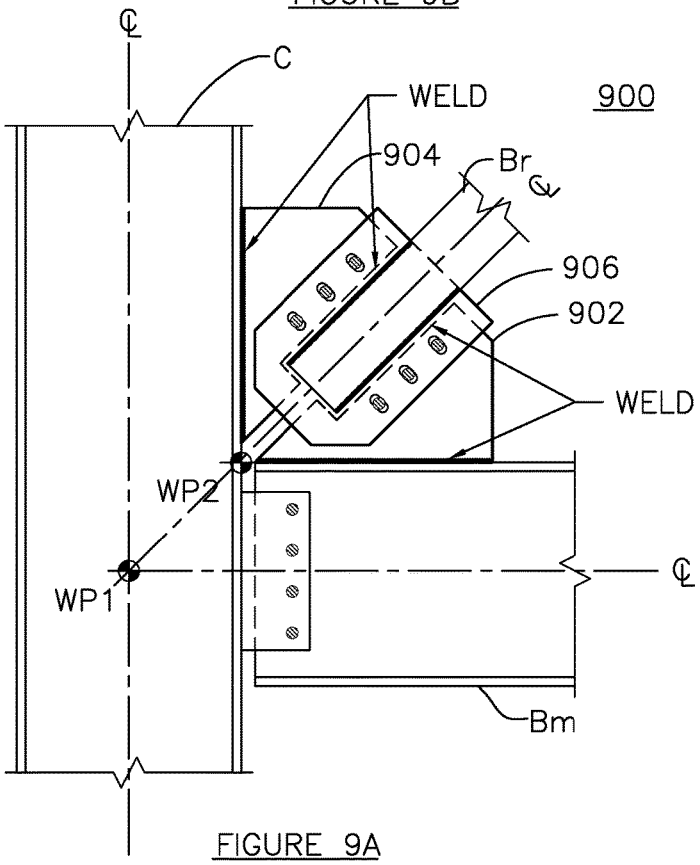

FIG. 9A shows a beam-column-brace assembly connected by a gusset assembly 900, according to one embodiment of the invention. FIG. 9A shows a new configuration of the invention (similar to the one depicted in FIG. 6) with the gusset assembly 900 having three plates. The first plate 902 is fixedly connected to the beam Bm and a second plate 904 is fixedly connected to the column C. A third (or main) plate 906 is fixedly connected to the brace Br (in this case welded). The third plate 906 is moveably connected to the first plate 904 via slotted bolt holes arranged perpendicular to the centerline of the brace Br. The third plate 906 is also moveably connected to the second plate 904 via slotted bolt holes arranged perpendicular to the centerline of the brace Br. Gaps exist between the edge of the third plate 906 and both the beam Bm and column C. The third plate 906 can be furnished as a single plate portion bolted to one side of the first and second plates 902/904, such that it only contacts one of the first and second plates, or the third plate can be arranged as two plate portions sandwiching the first and second plates 902/904 welded to the beam Bm and column C.

FIG. 9B and FIG. 9C show alternative arrangements for connecting the brace Br to the third plate 906, by a physical pin and bolting, respectively.

Figure 9D:
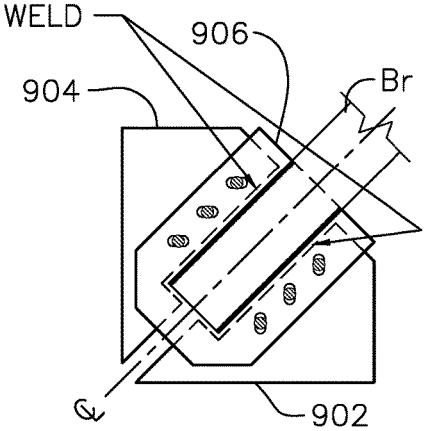

FIG. 9D shows the same beam-column-brace assembly of FIG. 9A with the slotted bolt holes in second plate 904 being parallel to the beam Bm and the slotted holes in the first plate being parallel to the column C. This arrangement may provide the added advantage of isolating the forces transferred from the brace to the beam and column as outlined in FIG. 2B.

Figure 10:
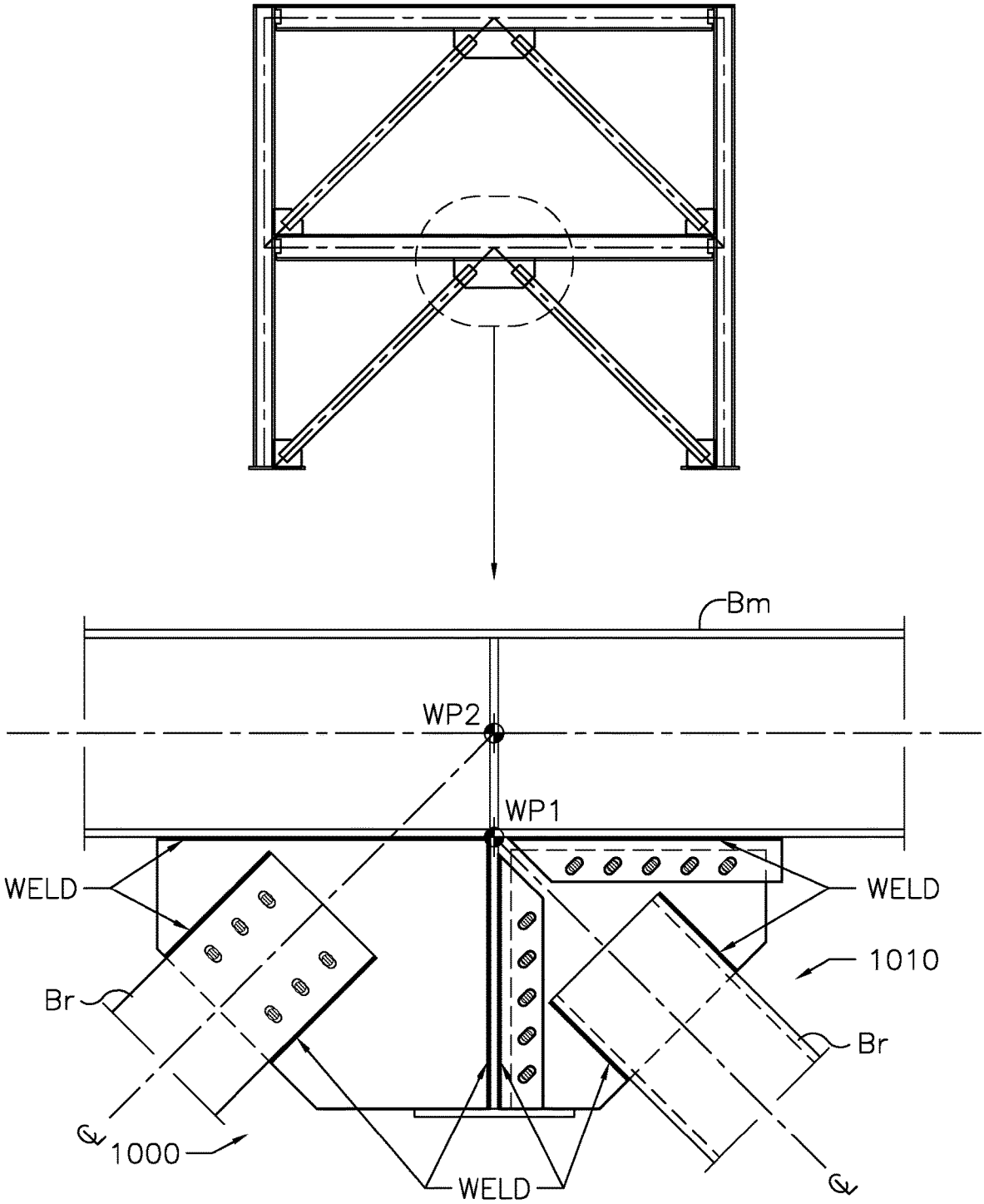
FIG. 10 is a side view of a beam and brace gusset assembly, according to one embodiment of the invention.

Embodiments of the invention are not limited to beam Bm and column C joints. For example, FIG. 10 shows two different configurations of gusset assemblies for attaching a brace Br to a mid-portion of a beam Bm (where two braces Br meet at a beam Bm). Two different gusset assemblies are shown for the sake of brevity, in some embodiments this may be the case, and in other embodiments the configurations can be identical. The left hand side shows a gusset assembly 1000, which is similar to the one depicted in FIG. 2A. The right hand side shows a gusset assembly 1010, which has a configuration similar to the one depicted in FIG. 6A.

Figure 11:
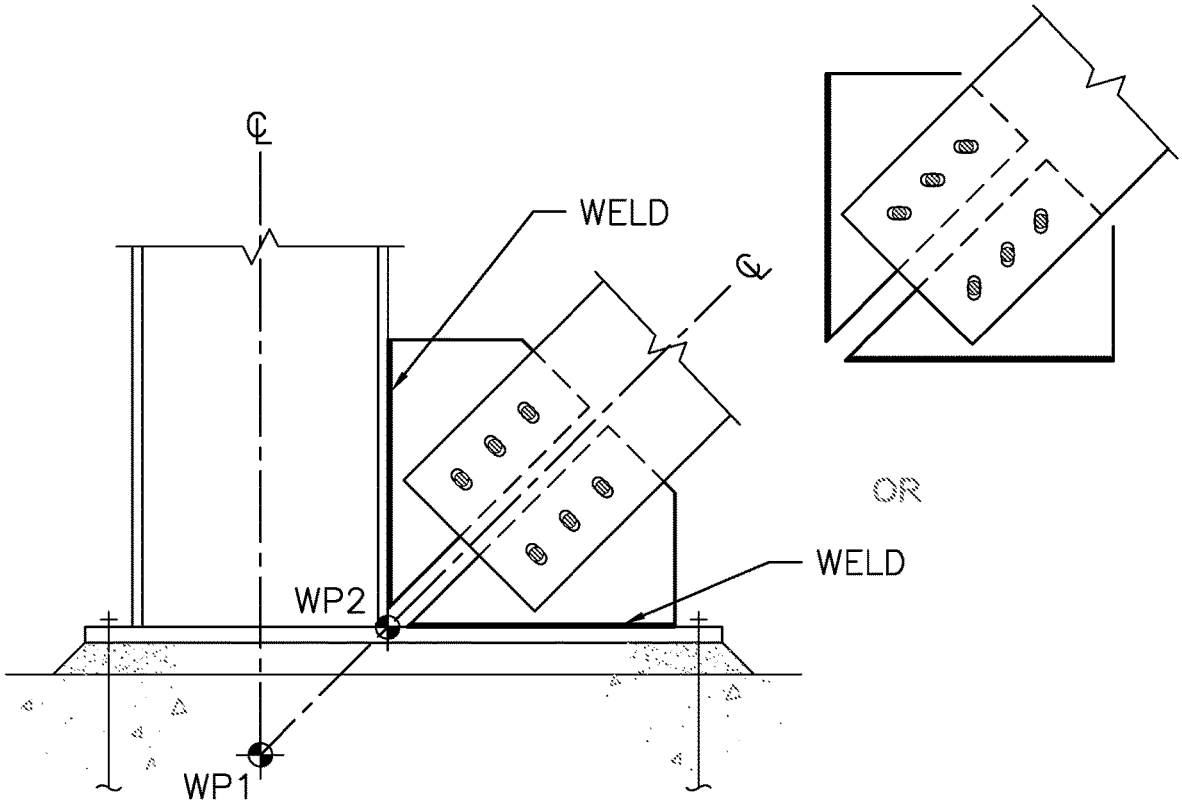
FIG. 11 is a side view of a column and ground gusset assembly, according to one embodiment of the invention.

FIG. 11 is another example of an application of the invention to a different portion of a building structure. Here, the gusset assembly disclosed in FIG. 2A is applied to a column-brace-base plate location. It should be understood, that all the gusset assemblies disclosed herein can be applied at the column-brace-base plate location by replacing a beam with a base plate in the disclosed figures.

Figure 12:
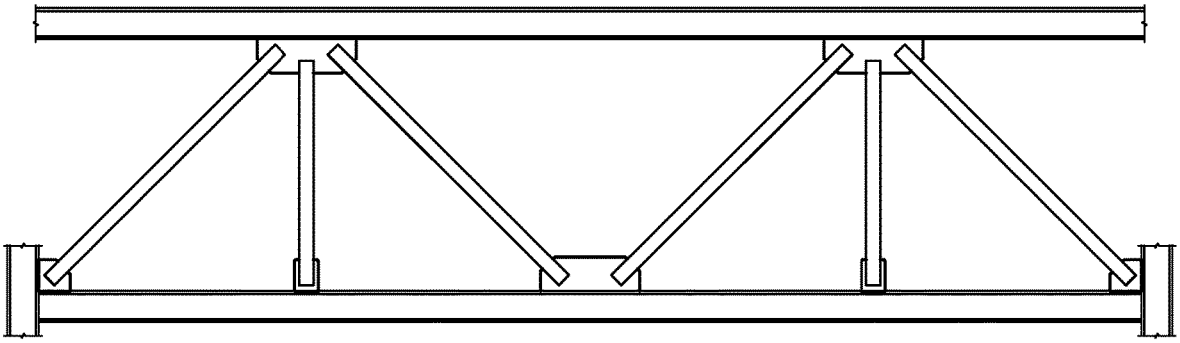
FIG. 12 is a side view of a truss constructed using gusset assemblies, according any of the gusset assemblies disclosed in FIGS. 2A-11.

Embodiments of the invention are not limited to building structures, but can be applied to many load bearing structures that typically use beam and column construction. For example, FIG. 12 shows a typical truss. Any of the joints shown can be constructed according to the embodiments disclosed herein. Generally, embodiments of the invention are constructed according to known techniques for structural building construction.

The above description is illustrative and is not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

One or more features from any embodiment may be combined with one or more features of any other embodiment without departing from the scope of the invention.

A recitation of "a", "an" or "the" is intended to mean "one or more" unless specifically indicated to the contrary.

What is claimed is:

1. A structural joint, comprising:

a column, wherein a first gusset portion is fixedly and directly connected to the column;

a horizontal member fixedly connected to the column, the horizontal member and column forming a first joint of a braced frame, wherein a second gusset portion is fixedly and directly connected to the horizontal member, wherein the second gusset portion does not contact the column and the first gusset portion does not contact the horizontal member; and a brace moveably connected to the first joint, the brace extending away from the first joint for connection to a second joint of the braced frame, the brace being configured to transfer force between the first and second joints, wherein the brace includes a joint connection portion that is moveably connected to each of the first and second gusset portion such that the first gusset portion, second gusset portion, and joint connection portion together form a gusset that braces the first joint, wherein the joint connection portion connects the first gusset portion to the second portion.

2. The structural joint of claim 1, wherein the first gusset portion and second gusset portions are first and second gusset plates, respectively, and wherein the first gusset plate comprises a first gusset plate interior face and a second gusset plate exterior face opposite the first gusset plate interior face, wherein the second gusset plate comprises a second gusset plate interior face and a second gusset plate exterior face opposite the second gusset plate interior face.

3. The structural joint of claim 2, wherein the first and second gusset plate interior faces are separated by a gap, wherein the joint connection portion is connected between the first gusset plate and the second gusset plate within the gap.

4. The structural joint of claim 2, wherein the first and second gusset plate interior surfaces contact each other, and wherein the joint connection portion contacts one or both of the first and second gusset plate exterior surfaces.

5. The structural joint of claim 2, wherein the first gusset plate is fixedly attached to the column so as to be offset from a first centerline that bisects the column.

6. The structural joint of claim 5, wherein the second gusset plate is fixedly attached to the horizontal member so as to be offset from a second centerline that bisects the horizontal member.

7. The structural joint of claim 6, wherein the first and second centerlines intersect at a working point of the first joint, and wherein first gusset plate and the second gusset plate are arranged to move in different planes when extreme dynamic loads are applied to the braced frame.

8. The structural joint of claim 2, wherein the first gusset plate is fixedly attached to the column so as to be parallel and out of plane with respect to a first web of the column.

9. The structural joint of claim 8, wherein the second gusset plate is fixedly attached to the horizontal member so as to be parallel and out of plane with respect to a second web of the horizontal member.

10. The structural joint of claim 9, wherein the first and second webs are arranged in plane with respect to one another, and wherein first gusset plate and the second gusset plate are arranged to move in respective first and second planes when extreme dynamic loads are applied to the braced frame.

11. The structural joint of claim 1, wherein the joint connection portion comprises a plurality of bolts that pass through horizontally oriented, vertically oriented, angularly oriented, or curved slots of the at least one of the first and second gusset portions.

12. The structural joint of claim 1, wherein the joint connection portion comprises a pin.

13. The structural joint of claim 1, wherein the first gusset portion and second gusset portion are stubs, the stubs being moveably connected to the joint connection portion.

14. The structural joint of claim 13, wherein the stubs are moveably connected to the joint connection portion by a plurality of bolts.

15. The structural joint of claim 14, wherein the plurality of bolts pass through horizontally oriented, vertically oriented, angularly oriented, or curved slots of the stubs.

16. The structural joint of claim 1, wherein the gusset formed by the first gusset portion, second gusset portion, and joint connection portion allows for relative movement between the horizontal member and column when extreme dynamic loads are applied to the braced frame.

17. The structural joint of claim 16, wherein the gusset formed by the first gusset portion, second gusset portion, and joint connection portion does not allow for relative movement between the horizontal member and column when normal dynamic loads are applied to the braced frame.

18. The structural joint of claim 1, wherein at least one of the first gusset portion, second gusset portion, and joint connection portion comprises an opening with a pathway for allowing travel of a connector along the pathway when extreme dynamic loads are applied to the braced frame.

* * * * *